United States Patent [19]

Barry et al.

[11] Patent Number: 4,649,288

[45] Date of Patent: Mar. 10, 1987

[54] PRE-START WARNING SYSTEM AND MACHINE INCORPORATING SUCH SYSTEM

[75] Inventors: Michael J. Barry, Pontefract; Adrian Senior, Barnsley; Alan E. Beech, Huddersfield, all of England

[73] Assignee: Dresser U.K. Limited, London, England

[21] Appl. No.: 707,455

[22] Filed: Mar. 1, 1985

Related U.S. Application Data

[63] Continuation-in-part of Ser. No. 520,845, Aug. 5, 1983.

[30] Foreign Application Priority Data

Aug. 14, 1982 [GB] United Kingdom ..... 8223441

[51] Int. Cl.[4] ..... H02K 19/34; E21C 35/04

[52] U.S. Cl. ..... 307/84; 307/18; 322/10; 299/1; 299/12; 361/47

[58] Field of Search ..... 307/18, 84; 322/10, 322/11, 12, 26, 33, 99; 367/140, 136; 299/1, 12; 340/508, 532, 538, 566, 568, 384 R; 361/47–50

[56] References Cited

U.S. PATENT DOCUMENTS

| | | | |
|---|---|---|---|
| 3,683,255 | 8/1972 | Schroeder | 299/12 X |
| 3,723,750 | 3/1973 | Dixon et al. | 307/84 X |
| 3,967,180 | 6/1976 | Weber et al. | 361/47 X |
| 4,066,992 | 1/1978 | Buller et al. | 299/12 X |
| 4,080,642 | 3/1978 | Stolarczyk | 361/47 |
| 4,087,698 | 5/1978 | Myers | 307/84 |
| 4,270,800 | 6/1981 | Barry | 299/1 |

FOREIGN PATENT DOCUMENTS

| | | | |
|---|---|---|---|
| 2854025 | 7/1979 | Fed. Rep. of Germany | 299/12 |
| 723186 | 3/1980 | U.S.S.R. | 299/12 |
| 876998 | 11/1981 | U.S.S.R. | 299/12 |

*Primary Examiner*—William M. Shoop, Jr.
*Assistant Examiner*—Shik Luen Paul Ip
*Attorney, Agent, or Firm*—Trexler, Bushnell & Wolters, Ltd.

[57] ABSTRACT

A power supply system for supplying electrical energy at an I.S. level to an electrical machine e.g. of a mineral mining machine, comprises two low speed generators A and B mechanically coupled together at coupling 3 and rotatable by means of a drive shaft 2, the mechanical input at the drive shaft 2 producing a separate, isolated electrical output at each of the generators A and B, the output from a first generator A being fed to an I.S. barrier 10, whereby an I.S. power supply is made available to power a first circuit 4, the output from the second generator B being fed to a non-I.S. supply circuit 8, and an I.S. coupling device 7 between the I.S. circuit 4 and the non-I.S. circuit 8, to achieve electrical and physical segregation of the circuits 4 and 8.

15 Claims, 6 Drawing Figures

PRE-START WARNING SYSTEM AND MACHINE INCORPORATING SUCH SYSTEM

CROSS-REFERENCE TO COPENDING APPLICATION

This application is a continuation-in-part of an earlier filed application, Ser. No. 520,845, filed Aug. 5, 1983.

This invention relates to a pre-start system for supplying electrical energy at an intrinsically safe (hereinafter referred to as I.S.) level to an electrical machine e.g. an electric motor in a potentially hazardous atmosphere location e.g. on a mining machine, in a chemical works, oil refinery, ordnance factory etc; and specifically to a mining machine incorporating such a system. I.S. is to be ascribed the usual meaning in the art e.g., as defined in "Code of Federal Regulations", Title 30—Mineral Resources—Chapter 1—Mine Safety and Health Administration, page 93.

Considering a mining machine for example, a conventional shearer type mining machine incorporates audible pre-start warning systems to warn personnel in the vicinity of imminent machine start-up, and conventional pre-start warning systems have precluded the supply of high voltage electrical energy (e.g. 1100 volts in British coal mines) until the audible pre-start warning has been emitted, and hence the machines have been required to embody a battery system to provide power for the pre-start warning system.

Known audible pre-start warning systems rely on float charged battery supplies to supply energy to the sounders, prior to the high voltage power being available at the machine, but these known battery systems have several disadvantages. Firstly, multiple pre-starts tend to deplete the batteries, secondly methods have to be made available for recharging the batteries from a suitable source, thirdly there has to be segregation between the I.S. source and a pilot line, which is normally limited to 250 volts, while sensors used in the pilot line, e.g. motor winding thermostats, normally requiring 1100 volt segregation, have to be excluded from such systems unless suitable isolation means can be provided, and fourthly space has to be made available in the machine body to house the batteries and associated recharging means.

Remote from the mining art, there is described in U.S. Pat. No. 4,087,698 (Myers) a system, particularly for use with windmills, for generating A.C. of selected voltage at a target frequency, the system including a plurality of co-axial A.C. generators with power input shafts drivable through a speed range, with stators unconventional in that they are rotatable, to maintain a relative speed appropriate to the target frequency. Hence the characteristics of the A.C. generators are arranged so that one gives a useful output. Thus for a system in which a varying speed drive shaft is present, Myers proposes the use of a plurality of generators of different speed/frequency characteristics.

In U.S. Pat. No. 4,270,800, (Barry) is described a machine pre-start warning system using a thermistor provided in a circuit including an I.S. barrier in the form of an optical barrier to permit or prevent machine start-up by closing or opening respectively the machine pilot circuit, but electrical energy to power the thermistor would be provided by the battery system described earlier.

Finally, the other item of prior art known to the Applicants is U.S. Pat. No. 3,683,255 (Schroeder) which describes a methane monitoring device, in which a hydraulic motor is employed to drive a generator, but no assistance is given on the derivation of an I.S. power supply.

An object of the present invention is to provide an I.S. power supply system employing two generators from both of which a useable electrical output may be obtained.

According to a first aspect of the present invention, there is provided a pre-start warning system for supplying electrical energy at an I.S. level to an electrical machine said system comprising two low speed generators mechanically coupled together, a drive shaft to rotate said generators and the mechanical input at said drive shaft producing a separate, isolated, electrical output at each of said generators, an I.S. barrier (as herein defined) and first and second circuits, said output from a first one of said generators being fed to said I.S. barrier, whereby an I.S. power supply (as herein defined) is made available to power said first circuit, said output from a second one of said generators being fed to said second circuit which is a non-I.S. circuit, and an I.S. coupling device between said I.S. circuit and said non-I.S. circuit, to achieve electrical and physical segregation of said first and second circuits.

It should be stated that the normal meaning in the art should be ascribed to terms such as I.S. barrier means and I.S. power supply. Thus by I.S. barrier means is meant a device which restricts electrical energy transmitted to units located in a hazardous environment to intrinsically safe levels, while by I.S. power supply is meant a supply in which the electrical energy is limited such that no spark or thermal effects produced in the supply is or are capable of causing ignition of a given explosive atmosphere.

Thus, with the pre-start warning system in accordance with the first aspect of invention, the two generators, which do not require differing speed/frequency characteristics, provide electrical and physical segregation of the I.S. circuit and the non-I.S. circuit, the electrical output from the generator feeding the non-I.S. circuit being incapable, under any circumstances, of contaminating the electrical output from the other generator providing power to the I.S. circuit, which in practice would normally be in a hazardous environment. The invention thus provides an I.S. power supply capable of interfacing with a non-I.S. circuit, to give total isolation of the two circuits, with high voltage interfacing between the I.S. supply and the non-I.S. supply.

The generators are conveniently A.C. generators and may be alternators or so called stepper motors which, when mechanically driven in the same manner as an alternator would produce an electrical output which output is self-regulating. The first circuit may for instance be a control and/or monitor circuit, while the second circuit may for instance form part of an electronic interfacing unit for the first circuit and a pilot circuit.

A suitable coupling device is an opto-coupled isolator, but alternatively a relay, with segregated contacts at required distances, may be employed.

According to a second aspect of the present invention, there is provided a mineral mining machine incorporating a pre-start warning system as defined above.

The machine may be of the shearer type or the continuous miner type. The machine may incorporate an audible pre-start warning device having an audible sounder and an acoustic monitor to monitor the output of the sounder for a predetermined time period, after which period the control and monitor circuit is able to energise the I.S. coupling device. If the latter is for instance constituted by an opto-coupled isolator, the control and pilot interface unit needs to be sensitive to energisation of the opto-coupled isolator, and energisation of the latter would enable the control and pilot interface unit in turn to energise a pilot relay which in turn closes a pilot line permitting the supply of high voltage electrical energy to the electrical machine involved.

As indicated previously, the generators may be stepper motors (the output of which is of course in the form of pulses) or low speed alternators. Furthermore, the drive shaft of the two low speed generators may be hand-driven via a handle; or alternatively hand-driven by a pull cord; or alternatively gas or fluid driven by a turbine or piston. With the latter arrangement the fluid may be high pressure water, which is already available at a shearer type mining machine for motor cooling purposes and/or dust suppression purposes.

The invention will now be described in greater detail, by way of examples, with reference to the accompanying drawings, in which.

Figure 1:
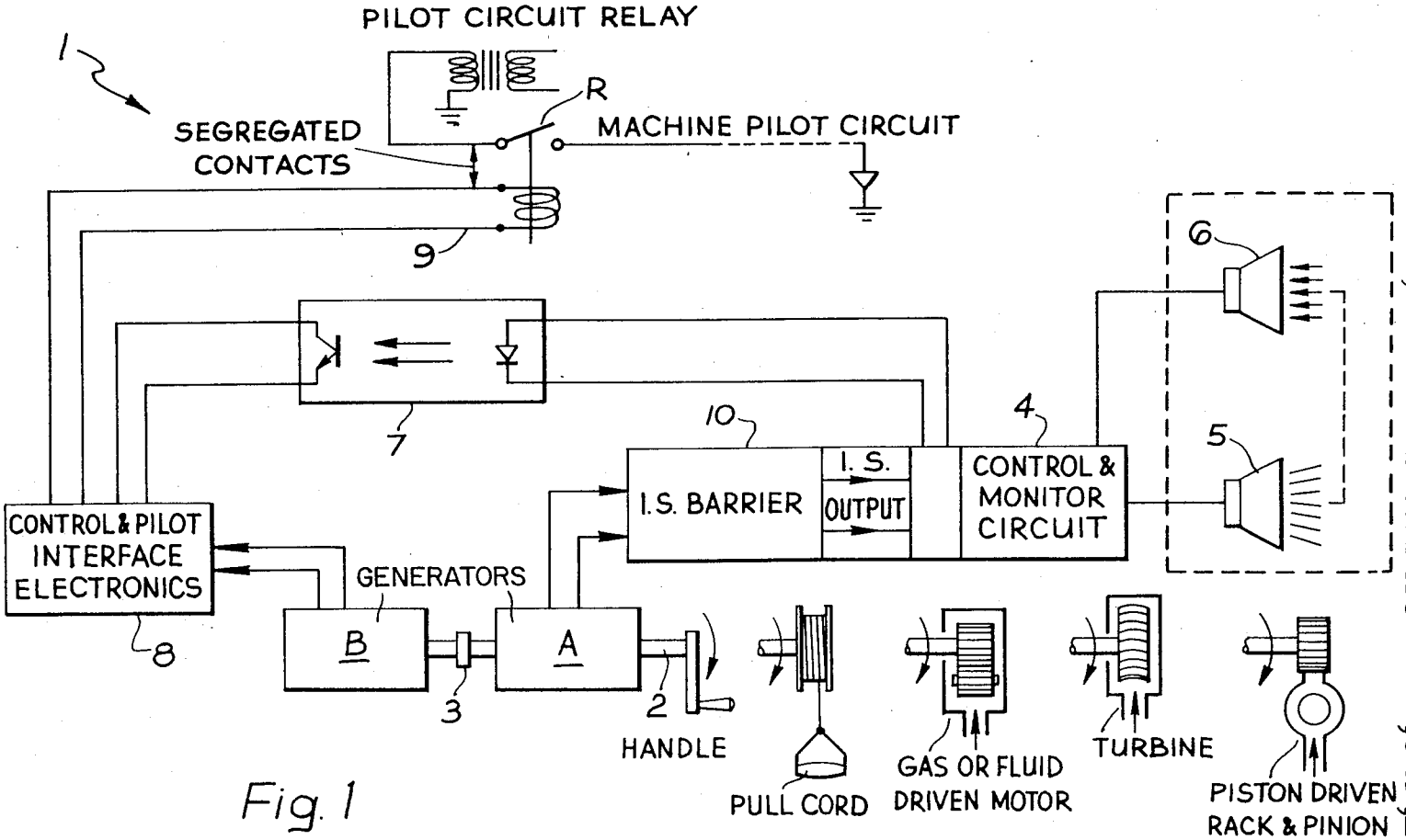
FIG. 1 shows diagramatically a pre-start warning system in accordance with one aspect of the invention, for a mining machine having an audible pre-start warning device.

In FIG. 1, circuit components of a pre-start warning system in accordance with the invention are designated generally by reference numeral 1. The electrical output from generator A is fed via an intrinsically safe (I.S.) barrier 10, such that an I.S. power supply is made available to power a control and monitor circuit 4. The control and monitor circuit 4 produces an output for driving an audible sounder, illustrated as a loudspeaker 5, which in turn is monitored via an acoustic detector illustrated as a microphone 6 for a pre-determined period of time. During this period, the control and monitor circuit 4 pulses the photoemitter of an opto-coupled isolator 7, in a manner to be described in detail later with reference to FIGS. 2 to 4. If no satisfactory acoustic monitoring signal is detected via the microphone 6 for a prescribed period of time, the photoemitter is not pulsed, and start-up of an associated mining machine cannot occur.

The electrical output from generator B is fed to a non-I.S. circuit, forming part of control and pilot interface electronics, indicated at 8 in FIG. 1. The control and pilot interface unit 8 detects the state of the phototransistor in the opto-coupled isolator 7, and the latter provides the necessary segregation required for interfacing from the I.S. supply (obtained via barrier 10) to the non I.S. supply. If sound has been produced and detected for the pre-determined time period, the phototransistor causes a pilot relay 9 to energise, which in turn closes a relay R of the pilot circuit (the relay R being illustrated as open in FIG. 1), thus allowing start-up of an associated mining machine.

Figure 2:
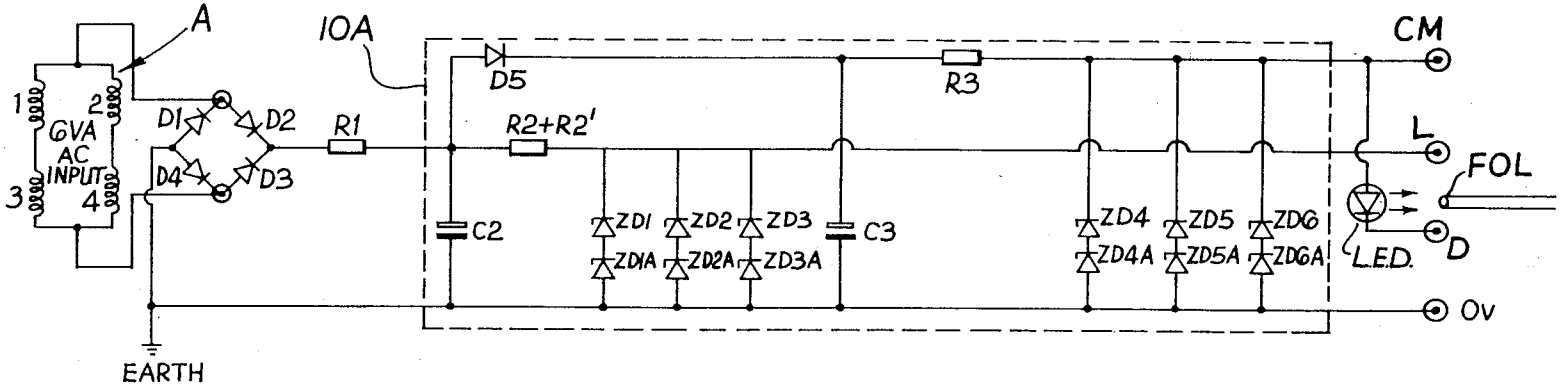
FIG. 2 shows in detail, the first generator of FIG. 1 and associated I.S. barrier circuit.
Figure 3:
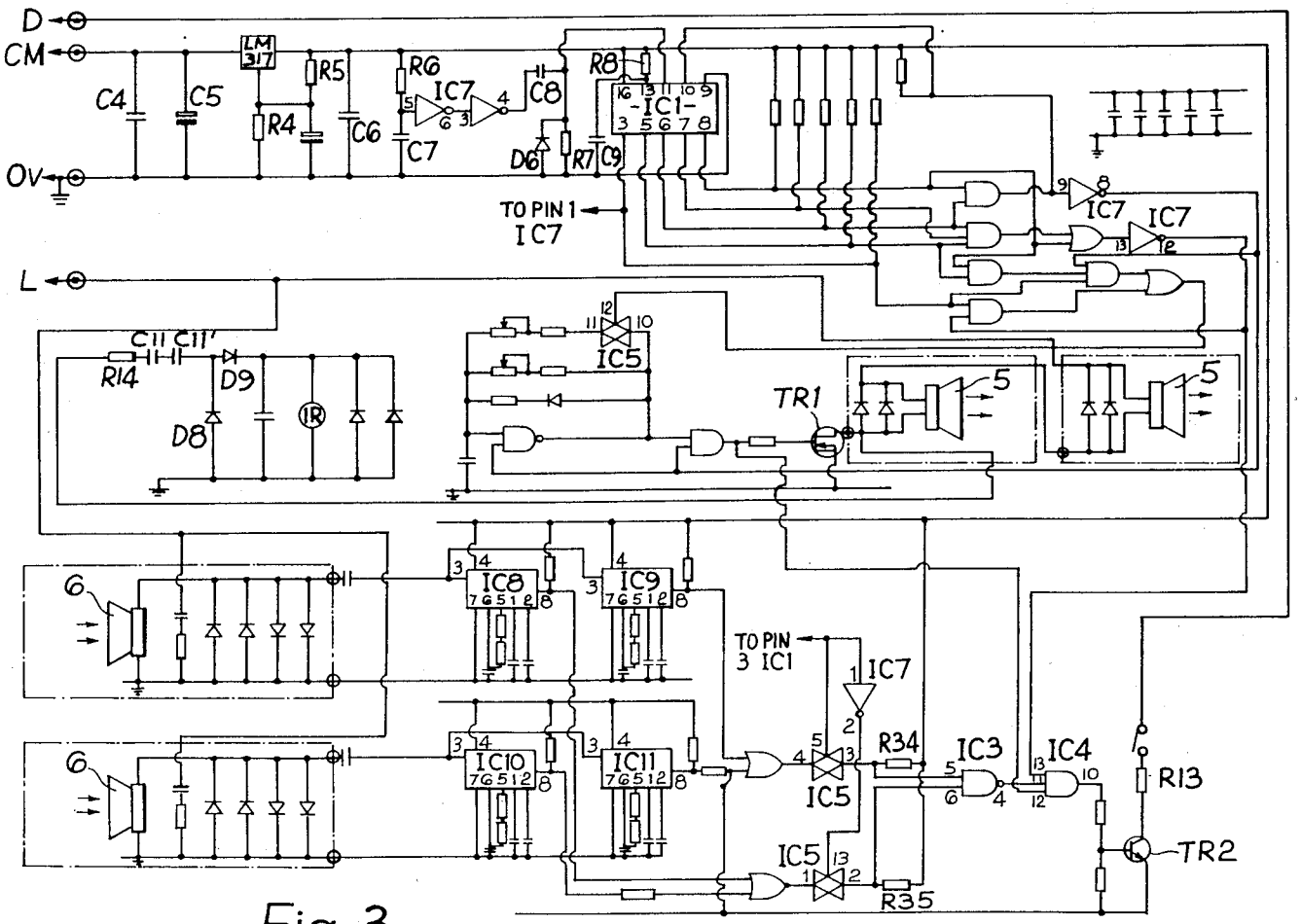
FIG. 3 shows in detail the I.S. control and monitor circuit.

Referring now to FIG. 2, the I.S. barrier 10 is constituted by the I.S. circuit within heavy dotted line 10A, which circuit is powered by the generator A, as mentioned previously. The circuit of the I.S. barrier 10 comprises twelve zener diodes ZD1 to ZD6A, while components D5 and C3 serve to de-couple the control and monitor circuit 4 from the two loudspeakers 5 that are illustrated in FIG. 3, with output C.M. to the control and monitor circuit 4, and I.S. output L to loudspeakers 5. A portion of the opto-coupled barrier 7 is also illustrated in FIG. 2, this being a photo-emitter in the form of a L.E.D., (designated as such) mounted in an explosion proof section of the I.S. circuit 10, on an I.S. power supply card. Adjacent the L.E.D., is one end of a fibre optic link, or light guide, indicated by reference FOL, to be referred to later.

In FIG. 3 the control and monitor circuit 4 derive its 7.5 volt supply from outputs CM and L of the I.S. barrier 10 of FIG. 2 via an on-board regulator LM317.

A 'power up' circuit, formed by 2 gates of IC7, trigger a programmable binary timer counter (IC1 Pin 11). Once triggered the time base oscillator section of IC1, whose frequency is controlled by R8 and C9, is clocked into the counter section of the I.C.

Pin 3 on IC1, produces a 2 Hz tone control frequency, which alternately switches into, and out of circuit, R9 and VR1 via analogue transmission gate, IC5. This action produces alternate High and Low frequency tones, of 1.3 KHz and 900 Hz respectively at the output of the tone generator, pin 4 IC3.

The resultant two tone output drives the loudspeakers 5 e.g., 8 Ohm horn loudspeakers, via TR1.

Output pins 5, 6, 7 and 8 on IC1 are further decoded to give logic zeros ('0s') at the following points on the circuit:

a. Pin 4 IC6, decoded to give a logic zero for a 7 second period, after which it resumes a logic '1' state.
b. Pin 10 IC2, is a logic '0' for a 9 second period before returning to a logic '1' state.
c. Pin 3 IC2, is a logic '0' for a 10 second period before it returns to a logic '1' state and re-sets the timer. Further gating of these decoded outputs produces an output from the loudspeakers 5 with the following pattern:

1. Alternate 'High' and 'Low' tones, with an output frequency of 1.3 KHz and 900 Hz respectively, alternating at a 2 Hz rate and lasting for a period of 7 seconds.
2. A continuous 900 Hz low frequency tone, lasting for a further 2 seconds, during which time an associated mining machine may be started.
3. Alternate 'High' and 'Low' frequency tones lasting for 1 second after the machine start tone has expired.

A diode pump circuit, formed by R14, C11, D8 and D9, energises relay 1R continually throughout the pre-start alarm period. This pump circuit checks that oscillatory signals are present at the output of the speaker drive transistor TR1, and consequently to the loudspeaker 5.

Two precision tone detetors, IC9 and IC8, each respectively having their centre frequencies at 1.3 KHz and 900 Hz, monitor the audible output from the loudspeakers 5 via the microphones 6. The output from the High tone detector, IC9 pin 8, will go to a logic '0' state when the detected frequency from the microphone is 1.3 KHz, the Low tone detector IC8, detects the 900 Hz Low tone in a similar manner.

When the correct detection of both High and Low tones occur, the outputs from both tone detectors will alternate between logic '0' and '1' levels at a 2 Hz rate. These two separate outputs are fed to the inputs of the analogue transmission gates, IC5, which in turn is controlled by the 2 Hz output frequency from pin 3 on the binary timer counter, IC1. The High and Low detected tones are thus alternatively switched through the transmission gate to pins 5 and 6 on the Nand Schmitt Trigger, IC3. These alternate logical '0' detected tones cause the output of the Schmitt Trigger pin 4, to remain in a logical '1' state throughout the 7 second pre-start alarm period.

Pin 11, on the AND gate IC4 is held at a logic '1' level by the output of the Schmitt Trigger. The High and Low frequency pulses (1.3 KHz and 900 Hz), are passed through the AND gate to the base of opto-emitter drive transistor TR2.

The opto-emitter is therefore driven by alternate blocks of 900 Hz and 1.3 KHz pulses via 1R/1 and drive transistor TR2. The fibre optic light guide FOL is used to achieve segretation between the I.S. and non-I.S. circuitry.

Where the two loudspeakers 5 are used (as would be the case for a relatively lengthy machine illustrated in FIG. 2) duplication of the tone detection circuit via IC11 and IC10 ensures that both loudspeakers are monitored throughout the pre-start alarm period.

Figure 4:
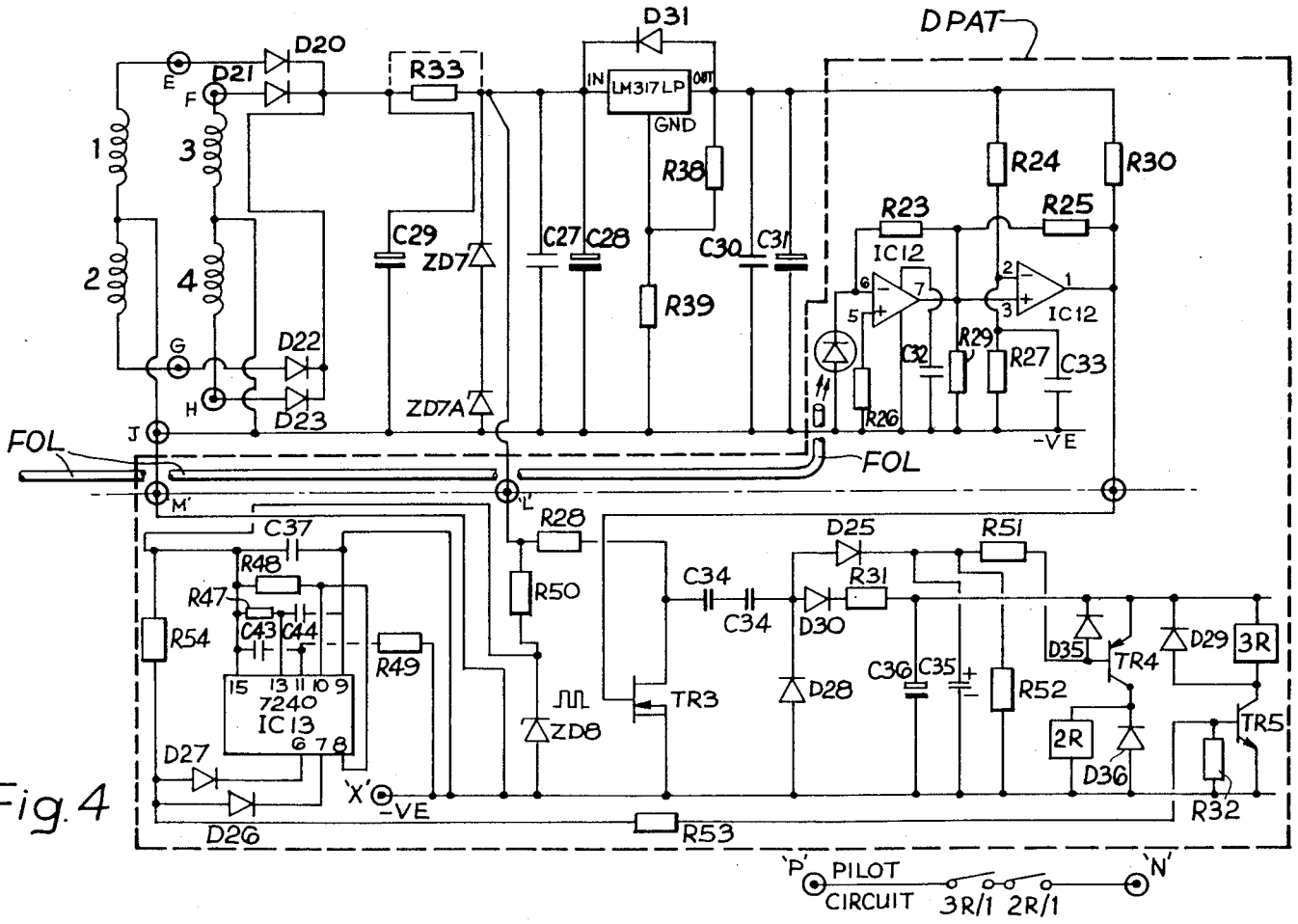
FIG. 4 shows in detail the non-I.S. circuit.

In FIG. 4 input power to the non-I.S. circuit forming the control and pilot interface electronics 8 is from the alternator/stepper motor B, power being rectified by diodes D20–D23, while capacitor C29 smoothes the rectified supply, and resistor R33 and zener diode ZD7 regulate the supply to 12 volts. The 12 volt supply is used to drive a diode pump circuit DPC (to be described in detail later). Further regulation, by an on-board regulator, provides an 8 volt stabilised noise free supply for pulse amplifier and detector circuits PAC and DC (also to be described in detail later).

In FIG. 4, a diode pump and amplifier and timing circuit (under the control of the I.S. supply, via the fibre optic link) is illustrated by the heavy dotted line marked DPAT. The latter includes an infra red detector IRD which monitors a fibre optic link output, the detected 900 Hz and 1300 Hz pulses are amplified by the amplifier and comparator circuit of IC12.

The reconstituted 900 Hz and 1300 Hz pulse train drives the gate of the pump transistor TR3, which in turn charges up capacitors C35 and C36. These two capacitors are 'pumped' up over the 7 second pre-start alarm period, failure to detect a block of 'high' or 'low' tone pulses, results in transistor TR4 conducting, this in turn loads up the power supply pump capacitor C36 discharging it via relay 2R.

A timing circuit, formed by IC13, is brought into operation the instant power is applied to the system. The output from this timer switches transistor TR5 and relay 3R after a 7 second period. This second timing circuit is totally independent from the 7 second pre-start alarm period and both relays 2R and 3R must be energised together to obtain a machine 'start' condition.

In detail, to obtain a 'start' condition, the following conditions must be satisfied.

1. Correct detection of 'high' and 'low' frequency tones.
2. 'High' and 'low' frequencies must be present for 7 seconds±0.5 seconds.
3. Pump capacitors C35 and C36 and their associated pump circuitry must be operational (i.e. failure of either will inhibit a start).
4. Both relays 2R and 3R must be pulsed at the same time to effect a start, they will remain energised for a period of approximately 2.0 seconds before reverting back to their deenergised state. The start push button, which is wired in series with the volt free contacts of relays 2R and 3R, must be closed within the 2.0 second window to energise the pilot circuit.

If the pilot circuit is not energised within this 2 second window, power must be removed from the pre-start alarm circuit before further attempts at starting the machine can be made.

Figure 5:
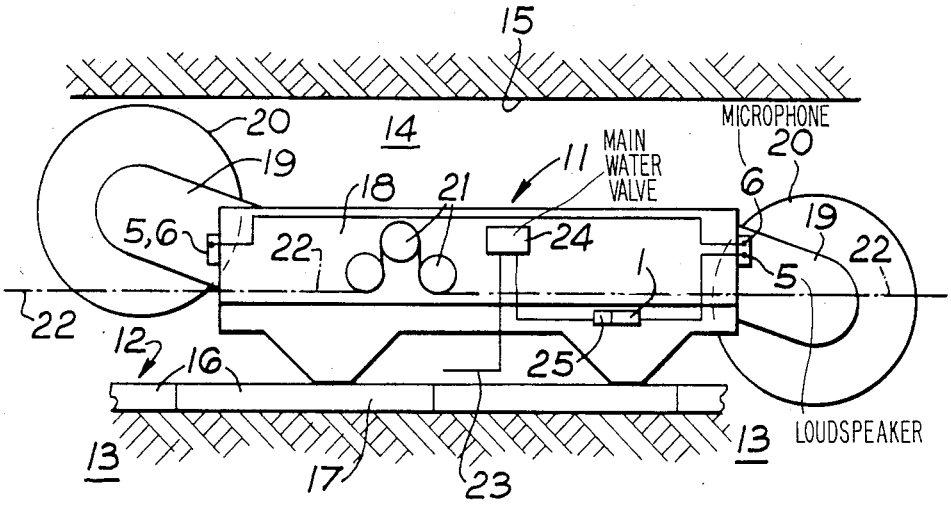
FIG. 5 is a side elevation of a shearer type mining machine in accordance with another aspect of the invention.

In FIG. 5, a shearer type mining machine 11 is mounted on, and guided by, an armoured scraper chain conveyor 12 seated on a mine floor 13 and extending along a mineral face 14, with a mine roof indicated at 15, the conveyor being made up to the desired length from a plurality of line pans 16 secured together end-to-end, and the goaf side sidewalls 17 being visible in FIG. 2.

The machine 11 is of the double-ended ranging drum shearer type comprising, at each end of the machine body 18, a ranging arm 19 pivotally attached to the machine body 18 and under the control of a double-acting hydraulic ram (not shown), each ranging arm carrying a rotary cutting head 20 provided with a plurality of picks (not shown) and powered through a speed reducing the transmission (not shown) along the arm and within the body 18 from a main electric motor (not shown) also housed within the body 18 in the conventional manner. The body 18 also houses a machine haulage unit incorporating drive sprockets 21 to engage, in the conventional manner, a tensioned haulage chain 22 staked at each end of the face 14. Supply of electric power to the machine 11 is by a cable (not shown) extending along the conveyor 12, in the conventional manner. Supply of water to the machine 11 is by a water hose 23 also extending along the conveyor 12, the water being for motor cooling/dust suppresion purposes, and additionally, in accordance with a preferred embodiment of the invention, and after passing through a main water valve 24, to rotate a turbine, contained within a housing 25, which turbine, in turn, serves to rotate the generators A, B of the power supply system of FIG. 1, indicated by reference numerals A, 10, 4, and 7–9, while a loudspeaker 5 and a microphone 6 are located at each end of the machine body 18.

Figure 6:
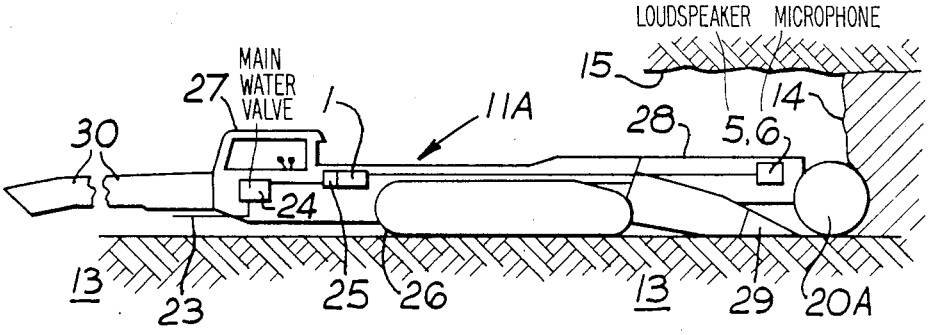
FIG. 6 is a side elevation of a continuous type mining machine.

In the embodiment of FIG. 6, like reference numerals are employed, where appropriate, to the embodiment of FIG. 2, FIG. 3 illustrating a continuous type mining machine 11A mounted on crawler tracks 26 and incorporating an operator's cab 27. A rotary cutting head 20A, extending the full width of the machine 11A is carried at one end of a ranging boom 28, while the forward end of the machine is provided with a pick-up conveyor or apron 29 adapted to collect from the mine floor 13 mineral detached by the cutting head 20A and to pass this to a further conveyor 30 of the machine 11A. In this embodiment a loudspeaker 5 and a microphone 6 are provided on the boom 28 and towards each end of the cutting head 20A.

What we claim is:

1. A pre-start warning system for supplying electrical energy at an intrinsically safe level to an electrical machine, said system comprising two low speed generators mechanically coupled together, a drive shaft to rotate said generators and the mechanical input at said drive shaft producing a separate, isolated, electrical output at each of said generators, an intrinsically safe barrier means and first and second circuits, a pre-start warning device incorporated in said first circuit, said output from a first one of said generators being fed to said intrinsically safe barrier means, whereby an intrinsically safe power supply is made available to power said first circuit and said pre-start warning device thereof, said output from a second one of said generators being fed to said second circuit which is a non-intrinsically safe circuit, and said barrier means incorporating an opto-coupled isolator constituted by a fibre-optic link between said intrinsically safe circuit and said non-intrinsically safe circuit, to achieve electrical and physical segretation of said first and second circuits, and said first circuit being a control and/or monitor circuit incorporating, as said pre-start warning device, an audible sounder, with an acoustic monitor to monitor the output of said sounder for a predetermined time period, after which period said control and/or monitor circuit is able to energise said intrinsically safe barrier means.

2. A system as claimed in claim 1, wherein said first circuit is a control and/or monitor circuit.

3. A system as claimed in claim 1, wherein said second circuit forms part of an electronic interfacing unit for said first circuit and a pilot circuit.

4. A system as claimed in claim 1, wherein said generators are stepper motors.

5. A system as claimed in claim 1, wherein said generators are low speed alternators.

6. A system as claimed in claim 1, wherein said drive shaft of said two low speed generators is hand drivable via a handle.

7. A system as claimed in claim 1, wherein said drive shaft of said two low speed generators is hand drivable via a pull cord.

8. A system as claimed in claim 1, wherein said drive shaft of said two low speed generators is gas driven.

9. A system as claimed in claim 1, wherein said drive shaft of said two low speed generators is fluid driven.

10. A system as claimed in claim 1, wherein said drive shaft of said two low speed generators is turbine driven.

11. A system as claimed in claim 1, wherein said drive shaft of said two low speed generators is piston driven.

12. A system as claimed in claim 7, wherein said fluid is high pressure water.

13. A mining machine incorporating a pre-start warning system for supplying electrical energy at an intrinsically safe level, said system comprising two low speed generators mechanically coupled together, a drive shaft to rotate said generators and the mechanical input at said drive shaft producing a separate, isolated, electrical output at each of said generators, an intrinsically safe barrier means and first and second circuits, a pre-start warning device incorporated in said first circuit, said output from a first one of said generators being fed to said intrinsically safe barrier means, whereby an intrinsically safe power supply is made available to power said first circuit and said pre-start warning device thereof, said output from a second one of said generators being fed to said second circuit which is a non-intrinsically safe circuit, and said barrier means incorporating an opto-coupled isolator constituted by a fibre-optic link between said intrinsically safe and said non-intrinsically safe circuit, to achieve electrical and physical segregation of said first and second circuits, and said first circuit being a control and/or monitor circuit incorporating, as said pre-start warning device, an audible sounder, with an acoustic monitor to monitor the output of said sounder for a predetermined time period, after which period said control and/or monitor circuit is able to energise said intrinsically safe barrier means.

14. A machine is claimed in claim 13, wherein said machine is of the shearer type.

15. A machine as claimed in claim 13, wherein said machine is of the continuous miner type.

* * * * *